US012371296B2

(12) United States Patent
Fujisaki et al.

(10) Patent No.: US 12,371,296 B2
(45) Date of Patent: Jul. 29, 2025

(54) LIQUID APPLICATION DEVICE, IMAGE FORMING APPARATUS, AND IMAGE FORMING SYSTEM

(71) Applicants: Kanako Fujisaki, Kanagawa (JP); Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Jun Yamada, Kanagawa (JP); Wataru Nozaki, Kanagawa (JP)

(72) Inventors: Kanako Fujisaki, Kanagawa (JP); Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Jun Yamada, Kanagawa (JP); Wataru Nozaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 18/592,713

(22) Filed: Mar. 1, 2024

(65) Prior Publication Data

US 2024/0294351 A1 Sep. 5, 2024

(30) Foreign Application Priority Data

Mar. 1, 2023 (JP) ..... 2023-031223

(51) Int. Cl.
*B65H 37/04* (2006.01)

(52) U.S. Cl.
CPC ..... *B65H 37/04* (2013.01); *B65H 2301/5126* (2013.01); *B65H 2301/5162* (2013.01)

(58) Field of Classification Search
CPC ..... G03G 15/6544; G03G 2215/00852; B31F 5/02; B65H 37/04; B65H 2301/51616;
(Continued)

(56) References Cited

U.S. PATENT DOCUMENTS 8,011,869 B2 * 9/2011 Trovinger ..... B42C 9/00 412/37
9,764,582 B2 * 9/2017 Taguchi ..... B65H 45/18
(Continued)

FOREIGN PATENT DOCUMENTS

JP 2014-201419 A 10/2014
JP 2014-201432 A 10/2014
(Continued)

OTHER PUBLICATIONS

Extended European Search Report issued Aug. 12, 2024 in European Patent Application No. 24160407.3, 7 pages.

*Primary Examiner* — Leslie A Nicholson, III
(74) *Attorney, Agent, or Firm* — XSENSUS LLP

(57) ABSTRACT

A liquid application device for applying liquid to a plurality of media to be crimped by a crimping device includes a
(Continued)

liquid applier and a liquid-applier moving mechanism. The liquid applier applies liquid to the plurality of media. The liquid-applier moving mechanism moves the liquid applier to a first position at which the liquid applier applies liquid to a medium on a conveyance path in the liquid application device and a second position at which the liquid applier applies liquid to the plurality of media inserted through a liquid application slit of the liquid application device.

17 Claims, 13 Drawing Sheets

(58) Field of Classification Search
CPC ..... B65H 2301/43828; B65H 2801/27; B65H 2301/5162; B65H 2201/1754; B65H 2201/0771; B65H 2201/0787
USPC ..... 270/58.07, 58.08
See application file for complete search history.

(56) References Cited

U.S. PATENT DOCUMENTS

| | | | | |
|---|---|---|---|---|
| 10,406,772 | B2 * | 9/2019 | Takahashi | B42C 1/12 |
| 2015/0360899 | A1 | 12/2015 | Takahashi et al. | |
| 2016/0060072 | A1 | 3/2016 | Watanabe et al. | |
| 2016/0068359 | A1 | 3/2016 | Suzuki et al. | |
| 2016/0114999 | A1 | 4/2016 | Suzuki et al. | |
| 2016/0221787 | A1 | 8/2016 | Matsushita et al. | |
| 2016/0340144 | A1 | 11/2016 | Sakano et al. | |
| 2016/0340145 | A1 | 11/2016 | Kunieda et al. | |
| 2016/0360053 | A1 | 12/2016 | Suzuki et al. | |
| 2017/0174465 | A1 | 6/2017 | Morinaga et al. | |
| 2017/0217239 | A1 | 8/2017 | Suzuki et al. | |
| 2018/0259895 | A1 | 9/2018 | Shibasaki et al. | |
| 2018/0339485 | A1 * | 11/2018 | Takahashi | B42C 1/12 |
| 2019/0276263 | A1 | 9/2019 | Hidaka et al. | |
| 2019/0284006 | A1 | 9/2019 | Hoshino et al. | |
| 2019/0284008 | A1 | 9/2019 | Sakano et al. | |
| 2019/0284009 | A1 | 9/2019 | Suzuki et al. | |
| 2019/0284010 | A1 | 9/2019 | Asami et al. | |
| 2019/0284011 | A1 | 9/2019 | Furuhashi et al. | |
| 2019/0284012 | A1 | 9/2019 | Yoneyama et al. | |
| 2019/0367317 | A1 | 12/2019 | Haraguchi et al. | |
| 2020/0103811 | A1 | 4/2020 | Sugiyama et al. | |
| 2020/0239265 | A1 | 7/2020 | Suzuki et al. | |
| 2020/0307936 | A1 | 10/2020 | Sugawara et al. | |
| 2020/0307944 | A1 | 10/2020 | Shibasaki et al. | |
| 2020/0385231 | A1 | 12/2020 | Kunieda et al. | |
| 2020/0407187 | A1 | 12/2020 | Hidaka et al. | |
| 2021/0039900 | A1 | 2/2021 | Shimazu et al. | |
| 2021/0316955 | A1 | 10/2021 | Shibasaki et al. | |
| 2021/0347589 | A1 | 11/2021 | Suzuki et al. | |
| 2021/0403273 | A1 | 12/2021 | Haraguchi et al. | |
| 2022/0055855 | A1 | 2/2022 | Shinoda et al. | |
| 2022/0289512 | A1 | 9/2022 | Takahashi et al. | |
| 2022/0334523 | A1 | 10/2022 | Akiyama et al. | |
| 2022/0363088 | A1 | 11/2022 | Yoshizawa et al. | |
| 2022/0380166 | A1 | 12/2022 | Nozaki et al. | |
| 2023/0001731 | A1 | 1/2023 | Haraguchi et al. | |
| 2023/0331029 | A1 | 10/2023 | Suzuki et al. | |
| 2023/0331507 | A1 | 10/2023 | Ota et al. | |
| 2023/0391568 | A1 | 12/2023 | Nozaki | |

FOREIGN PATENT DOCUMENTS

| | | | |
|---|---|---|---|
| JP | 2016-016973 | A | 2/2016 |
| JP | 2016-078950 | A | 5/2016 |
| JP | 2017-019592 | A | 1/2017 |

* cited by examiner

LIQUID APPLICATION DEVICE, IMAGE FORMING APPARATUS, AND IMAGE FORMING SYSTEM

CROSS-REFERENCE TO RELATED APPLICATION

This patent application is based on and claims priority pursuant to 35 U.S.C. § 119 (a) to Japanese Patent Application No. 2023-031223, filed on Mar. 1, 2023, in the Japan Patent Office, the entire disclosure of which is hereby incorporated by reference herein.

BACKGROUND

Technical Field

Embodiments of the present disclosure relate to a liquid application device, an image forming apparatus, and an image forming system.

Related Art

Known has been a medium processing apparatus that performs processing to bind a bundle of sheet-shaped media each having an image formed by an image forming apparatus. Note that a sheet of paper has been widely known as an exemplary sheet-shaped medium and thus, in the present specification, a "sheet bundle" that is a stack of sheets of paper is used as an exemplary bundle of sheet-shaped media. From the viewpoint of resource saving or reductions in environmental load, a medium processing apparatus includes a crimper that performs "crimping", that is, pinching a sheet bundle with concavo-convex binding teeth and deforming the sheet bundle under pressure, without any metallic staple.

In crimping, a larger number of sheets of paper in a sheet bundle hinder the binding teeth from biting into the sheet bundle, causing some bound sheets of paper to come off. Thus, as a disadvantage, the sheets of paper bound by crimping are difficult to keep properly. Thus, a medium processing apparatus that performs crimping includes a liquid applier that applies liquid in advance to the position with which binding teeth have contact on a sheet of paper (hereinafter, referred to as a "binding position") to cause the binding teeth to bite into a sheet bundle easily, leading to an enhancement in the strength of binding.

A medium processing apparatus having such a configuration as above enables application of liquid to sheets of paper that are to be bound by a crimper after being conveyed to the crimper by a conveyor (hereinafter, referred to as "auto binding") but fails to achieve application of liquid to sheets of paper that are to be bound by the crimper after being manually inserted into the crimper (hereinafter, referred to as "manual binding"). Thus, as a disadvantage, the strength of binding is difficult to enhance in manual binding.

SUMMARY

According to an aspect of the present disclosure, a liquid application device for applying liquid to a plurality of media to be crimped by a crimping device includes a liquid applier and a liquid-applier moving mechanism. The liquid applier applies liquid to the plurality of media. The liquid-applier moving mechanism moves the liquid applier to a first position at which the liquid applier applies liquid to a medium on a conveyance path in the liquid application device and a second position at which the liquid applier applies liquid to the plurality of media inserted through a liquid application slit of the liquid application device.

According to another aspect of the present disclosure, an image forming apparatus includes a housing; an image former housed in the housing to form an image on a medium; and the liquid application device. The liquid application device is detachably supported by the housing to apply liquid to the medium on which the image is formed by the image former.

According to still another aspect of the present disclosure, an image forming system includes an image forming apparatus to form an image on a medium; and the liquid application device. The liquid application device is connected to the image forming apparatus.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
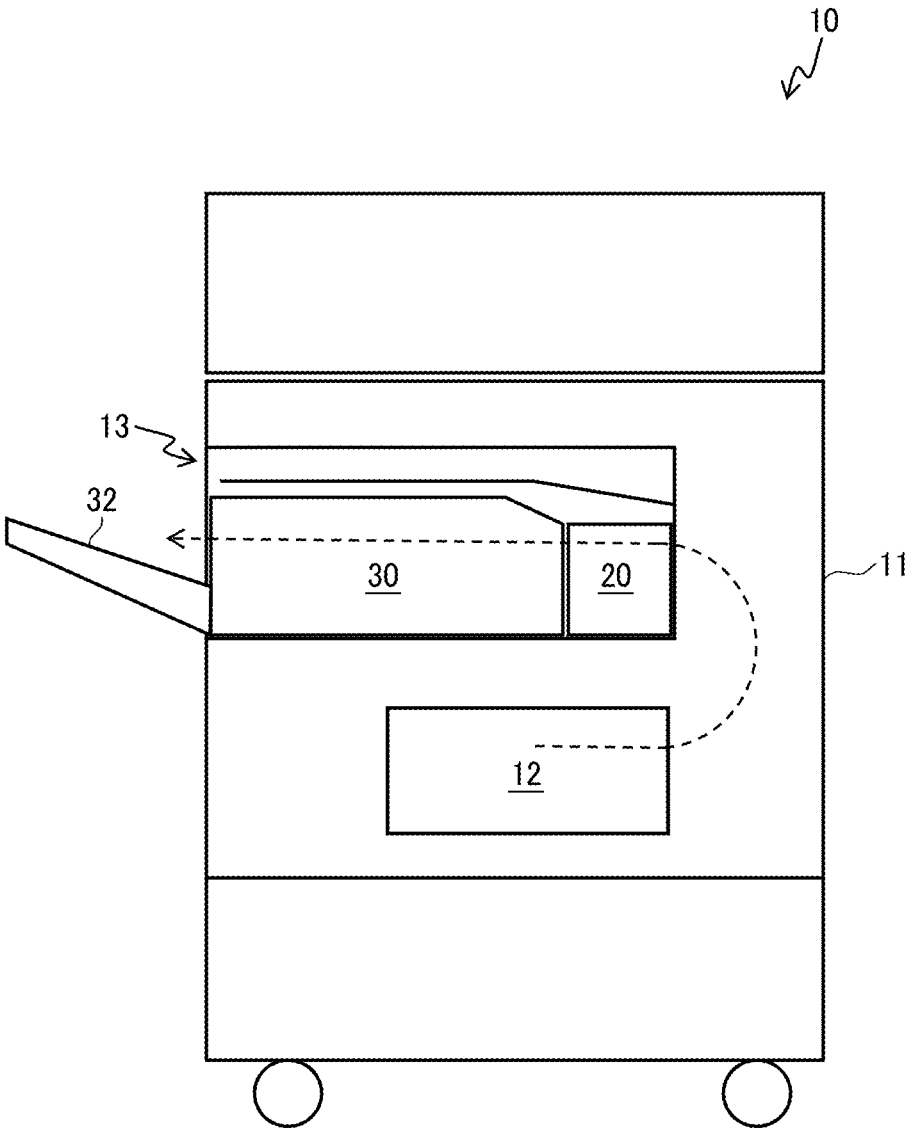
FIG. 1 is an external view of an image forming apparatus.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

An image forming apparatus 10 according to an embodiment of the present disclosure will be described below with reference to the drawings. FIG. 1 is an external view of the image forming apparatus 10. The image forming apparatus 10 forms an image on a sheet S (typically, a sheet of paper). As illustrated in FIG. 1, the image forming apparatus 10 includes a housing 11 and an image former 12.

The housing 11 is a boxy in shape and has an inner space in which the constituent components of the image forming apparatus 10 are housed. The housing 11 has an internal space 13 accessible from outside the image forming apparatus 10. For example, the internal space 13 is located slightly higher than the center in the up-down direction of the housing 11. The internal space 13 is exposed outward through a cutout of an outer side wall of the housing 11. Furthermore, the internal space 13 allows a liquid application unit 20 (liquid application device), a crimping unit 30 (crimping device), and a hole punch unit 50 described later (refer to FIG. 12) to be attached thereto.

The image former 12 forms an image on a sheet S housed in a tray and discharges the sheet S on which the image is formed to the liquid application unit 20, the crimping unit 30, or the hole punch unit 50. The image former 12 may be a type of inkjet that forms an image with ink or a type of electrophotography that forms an image with toner. The image former 12 has a publicly known configuration and thus detailed description thereof will be omitted.

The liquid application unit 20 is attached to the internal space 13 of the image forming apparatus 10 downstream of the image former 12 and upstream of the crimping unit 30 on a conveyance route for sheets S from the image former 12 to the crimping unit 30 (route indicated with a broken arrow in FIG. 1). That is, a sheet S on which an image is formed by the image former 12 is delivered to the liquid application unit 20 and then is subjected to liquid application processing described later. After that, the sheet S is delivered to the crimping unit 30 and then is subjected to crimping processing described later.

The liquid application unit 20 is detachably attached to the image forming apparatus 10. In a case where the liquid application unit 20 is detached, a sheet S on which an image is formed by the image former 12 is directly delivered to the crimping unit 30 and then is subjected to crimping processing. Furthermore, the hole punch unit 50 is detachably attachable to the position from which the liquid application unit 20 is detached in the internal space 13. In a case where the hole punch unit 50 is attached, a sheet S on which an image is formed by the image former 12 is delivered to the hole punch unit 50 and then is subjected to punching processing described later. After that, the sheet S is delivered to the crimping unit 30 and then is subjected to crimping processing. Note that, instead of the hole punch unit 50, a unit that performs any processing to a sheet S may be attached to the position from which the liquid application unit 20 is detached in the internal space 13.

Figure 2:
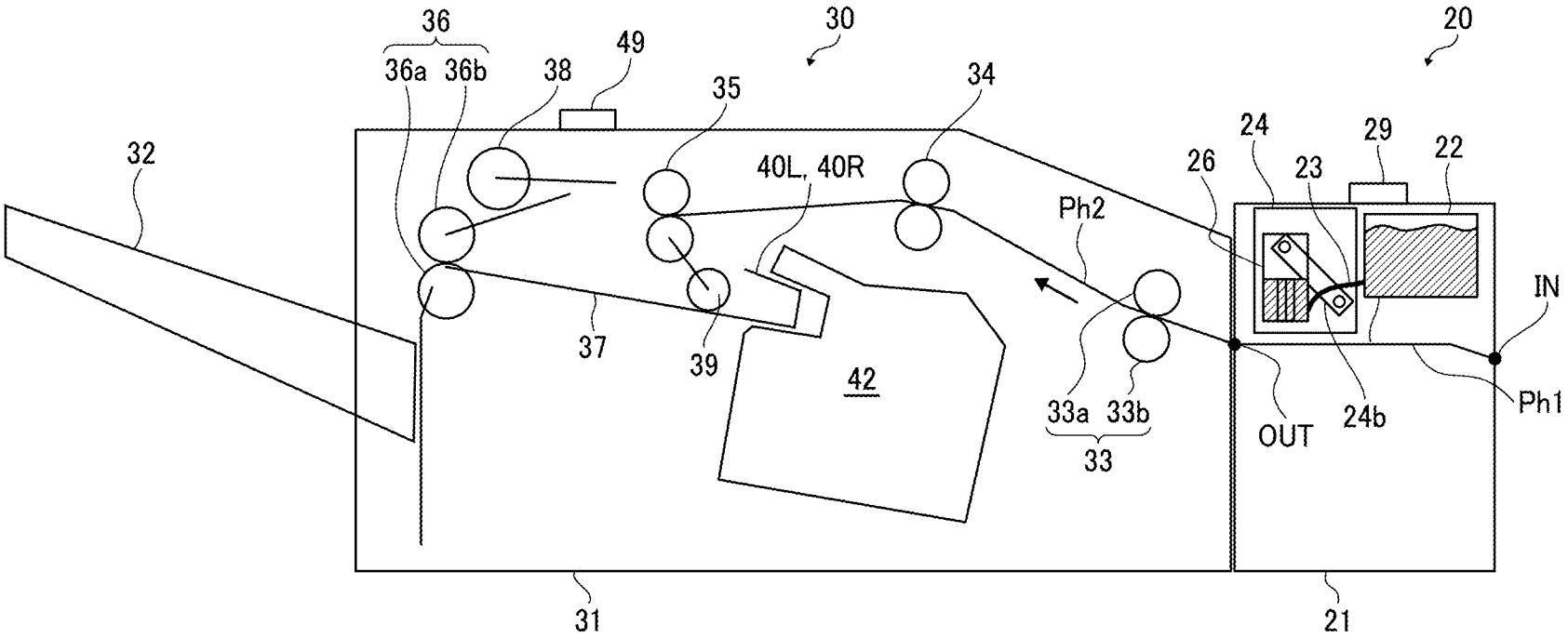
FIG. 2 illustrates respective inner configurations of a liquid application unit and a crimping unit.

FIG. 2 illustrates respective internal configurations of the liquid application unit 20 and the crimping unit 30. The liquid application unit 20 and the crimping unit 30 are each unitized. The liquid application unit 20 and the crimping unit 30 each enable connection of an input/output interface for sheets S. That is, the input interface IN of the liquid application unit 20 is connectable to the output interface of the image former 12. The input interface of the crimping unit 30 is connectable to the output interface of the image former 12 and the output interface OUT of the liquid application unit 20.

Figure 3B:
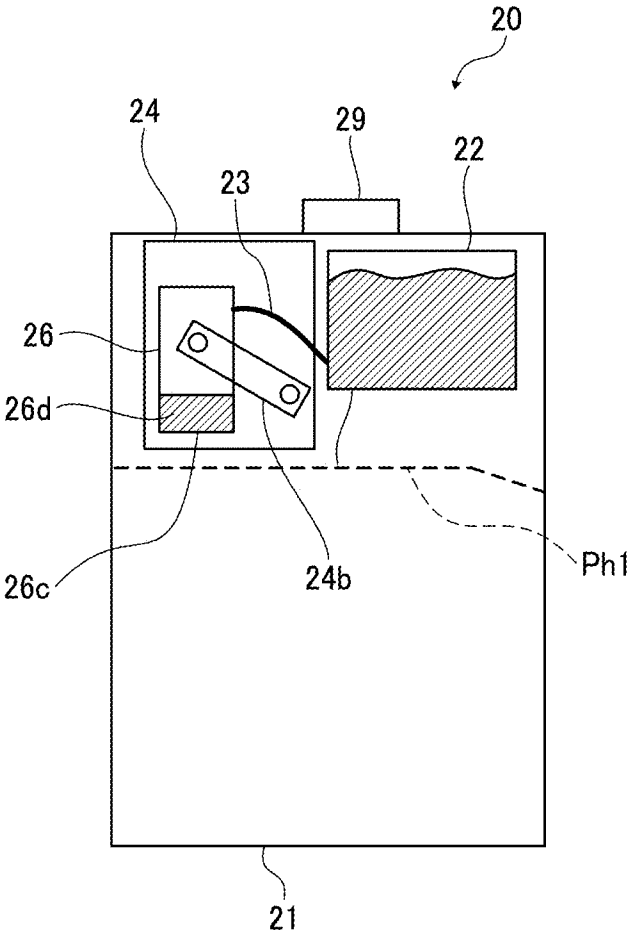
FIGS. 3A and 3B illustrate the liquid application unit viewed in a main scanning direction.
Figure 3A:
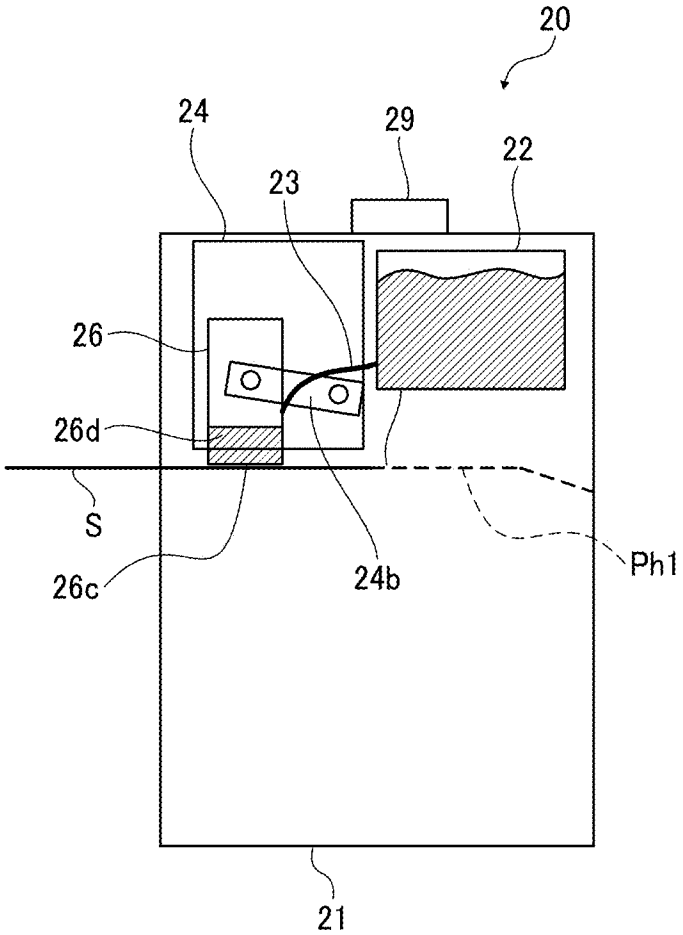
Figure 4C:
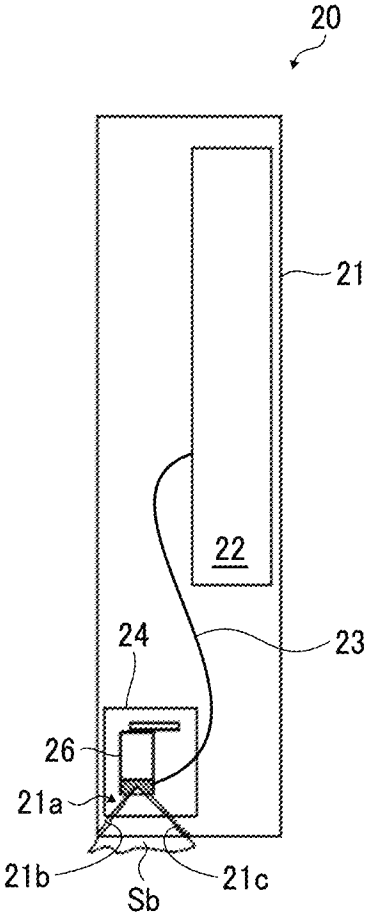
FIGS. 4A to 4C illustrate the liquid application unit viewed in the thickness direction of a sheet.
Figure 4B:
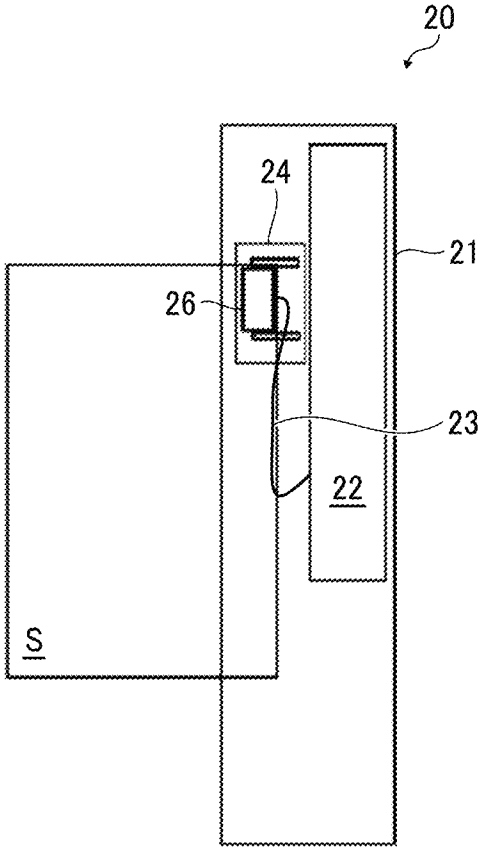
Figure 4A:
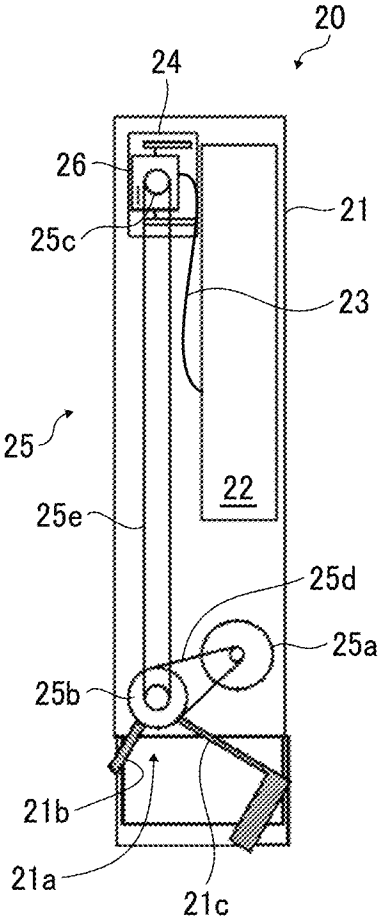
Figure 5C:
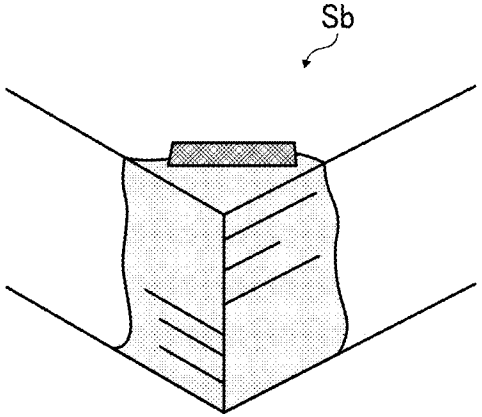
FIG. 5C illustrates a sheet bundle to which liquid is applied.
Figure 5B:
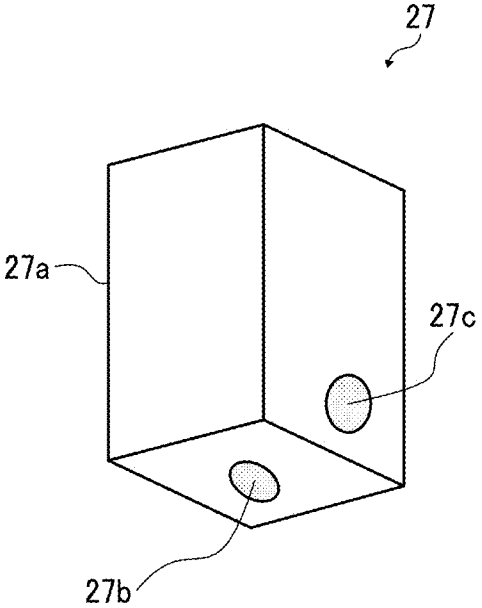
FIG. 5B illustrates an exemplary sprayer.
Figure 5A:
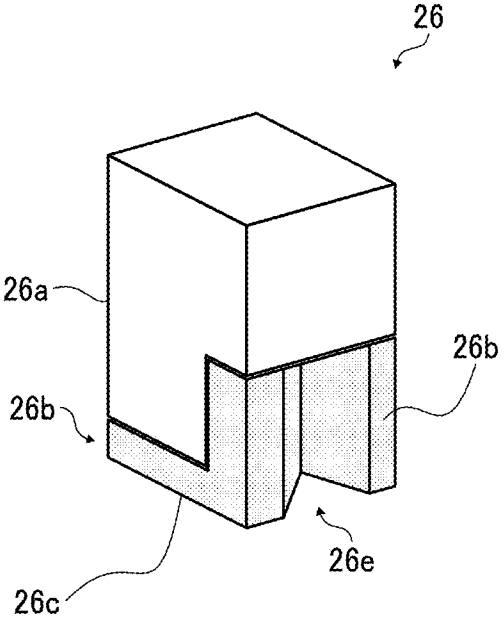
FIG. 5A illustrates an exemplary contact member.

FIGS. 3A and 3B illustrate the liquid application unit 20 viewed in a main scanning direction. FIGS. 4A to 4C illustrate the liquid application unit 20 viewed in the thickness direction of a sheet S. FIG. 5A illustrates an exemplary contact member 26. FIG. 5B illustrates an exemplary sprayer 27. FIG. 5C illustrates an exemplary sheet bundle Sb to which liquid is applied. As illustrated in FIGS. 2 to 4C, the liquid application unit 20 includes mainly a liquid application case 21, a liquid storage tank 22, a liquid feed tube 23, a liquid applier 24, a liquid-applier moving mechanism 25, and a manual application button 29.

The liquid application case 21 is boxy in shape and has an inner space in which the constituent components 22 to 25 of the liquid application unit 20 are housed. The inner space of the liquid application case 21 is provided with a conveyance path Ph1 serving as a space through which a sheet S passes. The conveyance path Ph1 ranges from the input interface IN connected to the image former 12 to the output interface OUT connected to the crimping unit 30. Hereinafter, the direction from the input interface IN to the output interface OUT on the conveyance path Ph1 is referred to as a "first conveyance direction" and the direction orthogonal to the first conveyance direction and the thickness direction of a sheet S on the conveyance path Ph1 is referred to as the "main scanning direction".

The liquid storage tank 22 stores liquid to be applied to sheets S. More specifically, the liquid stored in the liquid storage tank 22 for "liquid application" contains, as a main component, a liquid compound of hydrogen and oxygen represented by the chemical formula $H_2O$. Provided that the liquid compound is kept liquid, the liquid compound may be at any temperature and thus may be warm water or hot water. The liquid compound is not limited to pure water and thus may be purified water or may contain an ionized salt. The liquid compound is not limited in terms of metal ion content and thus may have any hardness in the range from soft water to ultrahard water.

The liquid stored in the liquid storage tank 22 may contain an additive in addition to the main component. The liquid stored in the liquid storage tank 22 may contain residual chlorine for use in tap water. The liquid stored in the liquid storage tank 22 desirably contains, as an additive, a colorant, a penetrant, a pH adjuster, a preservative such as phenoxyethanol, or a drying inhibitor such as glycerin. Ink for use in inkjet printers or ink for use in water-based pens contains, as a component, water. Thus, such ink may be used for the "liquid application".

The liquid stored in the liquid storage tank 22 is not limited to the specific examples given above. The liquid stored in the liquid storage tank 22 may be "water" in a broad sense such as hypochlorous acid water or an ethanol aqueous solution diluted for disinfection. However, tap water may be used simply for crimping because tap water is easy to obtain and manage. As the liquid stored in the liquid storage tank 22, a liquid of which the main component is such water as exemplified above enables an improvement in the strength of binding a sheet bundle Pb, in comparison to a liquid of which the main component is not water.

The liquid feed tube 23 feeds the liquid applier 24 the liquid stored in the liquid storage tank 22. The liquid feed tube 23 may feed the liquid applier 24 the liquid fed under pressure from the liquid storage tank 22 by a pump or may feed, based on capillary action or gravity, the liquid applier 24 the liquid stored in the liquid storage tank 22. Furthermore, the liquid feed tube 23 has a sufficient length and flexibility such that the liquid feed tube 23 can bend along with movement in the main scanning direction of the liquid applier 24.

The liquid applier 24 applies liquid to a sheet S. The liquid applier 24 is disposed above the conveyance path Ph1. The liquid applier 24 is configured to bring into contact with and separate from the sheet S on the conveyance path Ph1. More particularly, the liquid applier 24 includes a contact-separation motor 24*a* (refer to FIG. 7), a swing arm 24*b*, and a contact member 26.

The contact-separation motor 24*a* generates drive force for causing the contact member 26 to bring into contact with and separate from the sheet S on the conveyance path Ph1. The swing arm 24*b* has an end coupled to the output shaft of the contact-separation motor 24*a* and the other end coupled to the contact member 26. The swing arm 24*b* is supported swingably by a rotary shaft extending in the main scanning direction. Then, in response to rotation of the contact-separation motor 24*a* in a first direction, as illustrated in FIG. 3A, the lower face of the contact member 26 (first face 26*c* described later) contacts the upper face of the sheet S on the conveyance path Ph1. On the other hand, in response to rotation of the contact-separation motor 24*a* in a second direction counter to the first direction, as illustrated in FIG. 3B, the contact member 26 separates from the upper face of the sheet S on the conveyance path Ph1.

As illustrated in FIG. 4A, the liquid-applier moving mechanism 25 moves the liquid applier 24 in the main scanning direction. The liquid-applier moving mechanism 25 includes a liquid-applier moving motor 25*a*, pulleys 25*b* and 25*c*, and timing belts 25*d* and 25*e*. The timing belt 25*d* is stretched around the output shaft of the liquid-applier moving motor 25*a* and the pulley 25*b*. The timing belt 25*e* is stretched around the pulleys 25*b* and 25*c*. Furthermore, the liquid applier 24 is attached to the timing belt 25*e*. Thus, in response to transmission of rotation drive force from the liquid-applier moving motor 25*a*, the liquid applier 24 moves to a first position (refer to FIG. 4B) and a second position (refer to FIG. 4C) in the main scanning direction.

The first position is a position at which the liquid applier 24 can face the sheet S on the conveyance path Ph1. In other words, the first position is a position at which liquid can be applied to the sheet S on the conveyance path Ph1 (auto application). Note that the first position is not limited to the position in FIG. 4B and thus may be any position in the main scanning direction, provided that the liquid applier 24 can face the sheet S on the conveyance path Ph1. The second position is the position of a side end portion in the main scanning direction of the liquid application unit 20. In other words, the second position is a position at which liquid can be applied to a sheet bundle Sb (a stack of sheets S) inserted through a liquid application slit 21*a* described later of the liquid application case 21 (manual application).

The liquid application case 21 is provided with the liquid application slit 21*a* for manual application such that the liquid applier 24 faces the liquid application slit 21*a*. A corner of the sheet bundle Sb inserted inside the liquid application case 21 through the liquid application slit 21*a* can be subjected to manual application by the liquid applier 24 at the second position. The liquid application case 21 includes a pair of guide walls 21*b* and 21*c* provided in a V shape such that the liquid application slit 21*a* is surrounded. The pair of guide walls 21*b* and 21*c* positions the sheet bundle Sb to be subjected to manual application (namely, the sheet bundle Sb of which a corner is inserted in the liquid application slit 21*a*).

As illustrated in FIG. 5A, the contact member 26 includes a holder 26*a* and an elastic member 26*b*. The holder 26*a* is a part coupled to the swing arm 24*b*. The elastic member 26*b* is a part attached to the lower portion of the holder 26*a*. The elastic member 26*b* deforms elastically in response to contact with a sheet S and additionally can be soaked with the liquid fed through the liquid feed tube 23. The elastic member 26*b* is, for example, a sponge. Then, the elastic member 26*b* has a first face 26*c* and a second face 26*d* intersecting mutually.

The first face 26*c* is the lower face of the contact member 26 that faces the conveyance path Ph1 in the thickness direction of the sheet S on the conveyance path Ph1. Then, the first face 26*c* serves as a face that contacts the upper surface of the sheet S on the conveyance path Ph1. The second face 26*d* is a side face of the contact member 26 that faces the liquid application slit 21*a* in the main scanning direction. Then, the second face 26*d* serves as a face that contacts a side face of the sheet bundle Sb inserted inside the liquid application case 21 through the liquid application slit 21*a*. Furthermore, the second face 26*d* has a V-shaped groove 26*e* that receives a corner of the sheet bundle Sb.

Thus, the second face 26*d* contacts two side faces intersecting at a corner of the sheet bundle Sb inserted through the liquid application slit 21*a*. As a result, as illustrated in FIG. 5C, the sheet bundle Sb inserted through the liquid application slit 21*a* has two side faces, intersecting at a corner, to which liquid is applied. Note that the contact member 26 may apply liquid to one side face, the upper face, or the lower face of the sheet bundle Sb.

As another example, the liquid applier 24 may include a sprayer 27 illustrated in FIG. 5B, instead of the contact-separation motor 24*a*, the swing arm 24*b*, and the contact member 26. The sprayer 27 includes a holder 27*a*, a first spray opening 27*b*, and a second spray opening 27*c*. The holder 27*a* is supported by the liquid applier 24 and additionally is coupled to the liquid feed tube 23. The liquid supplied to the holder 27*a* through the liquid feed tube 23 is sprayed through the first spray opening 27*b* and the second spray opening 27*c*. Examples of a spray method that can be used include, but not particularly limited to, a method with air pressure.

The first spray opening 27*b* is provided at the lower face of the holder 27*a* that faces the conveyance path Ph1 (i.e., a surface of the holder 27*a* that faces the sheet S on the conveyance path Ph1). Then, liquid is sprayed to the sheet S on the conveyance path Ph1 through the first spray opening 27*b* with the liquid applier 24 at the first position. The second spray opening 27*c* is provided at a side face of the holder 27*a* that faces the liquid application slit 21*a*. Then, with the liquid applier 24 at the second position, liquid is sprayed, through the second spray opening 27*c*, to a side face of the sheet bundle Sb inserted inside the liquid application case 21 through the liquid application slit 21*a*.

Figure 7:
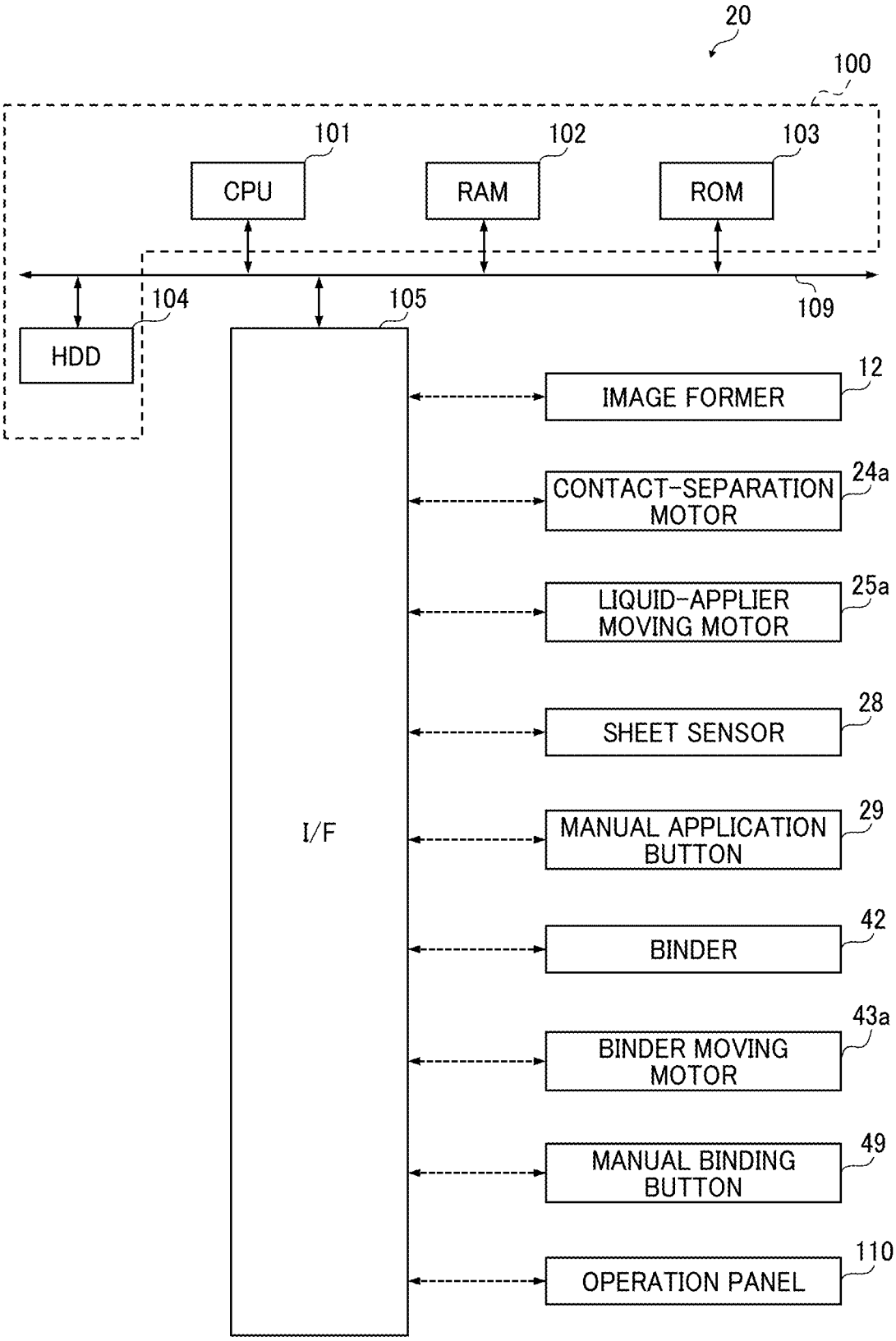
FIG. 7 illustrates a hardware configuration of the image forming apparatus.

The liquid application unit 20 includes a sheet sensor 28 that detects the sheet S has reached a predetermined position on the conveyance path Ph1 (refer to FIG. 7). The manual application button 29 gives an instruction for manual application to the liquid application unit 20. A user inserts a sheet bundle Sb into the liquid applier 24 through the liquid application slit 21*a* and then presses the manual application button 29 to cause the liquid applier 24 to perform manual application.

Figure 6A:
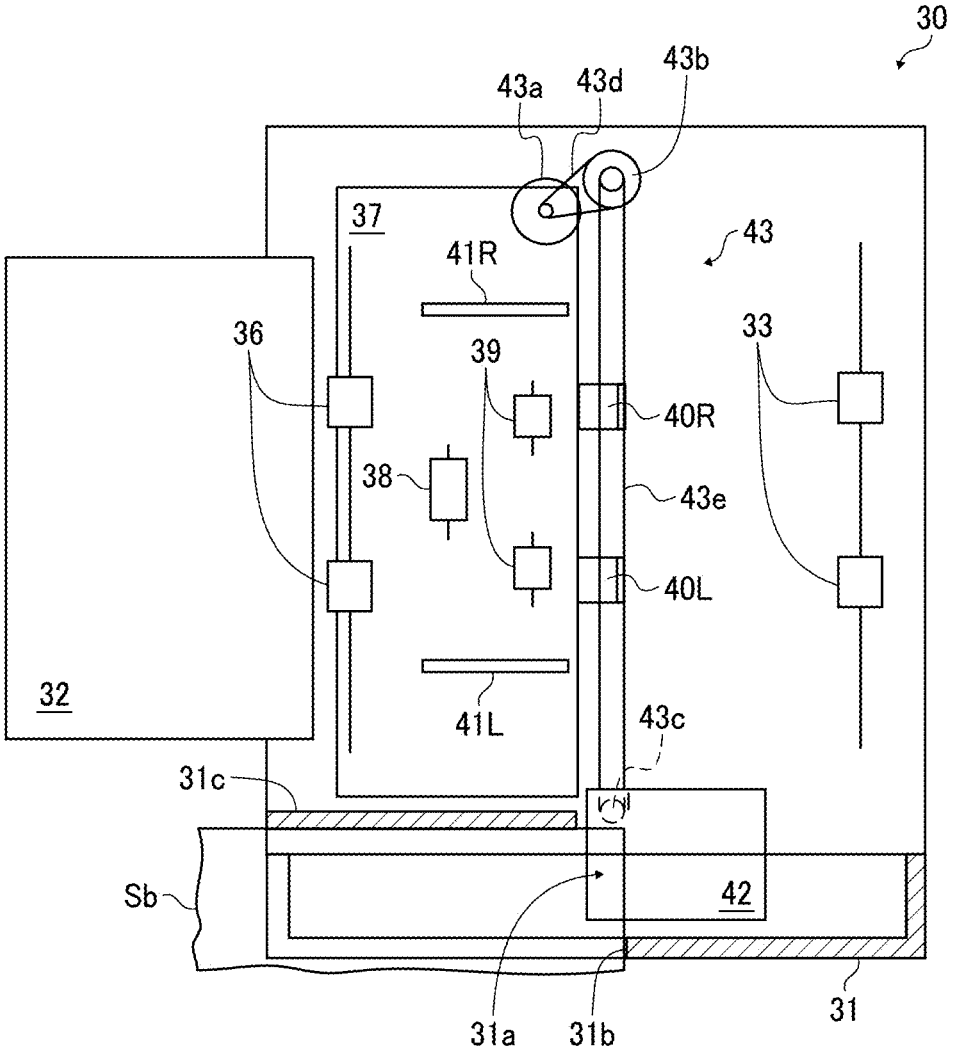
FIG. 6A illustrates the crimping unit viewed in the thickness direction.
Figure 6B:
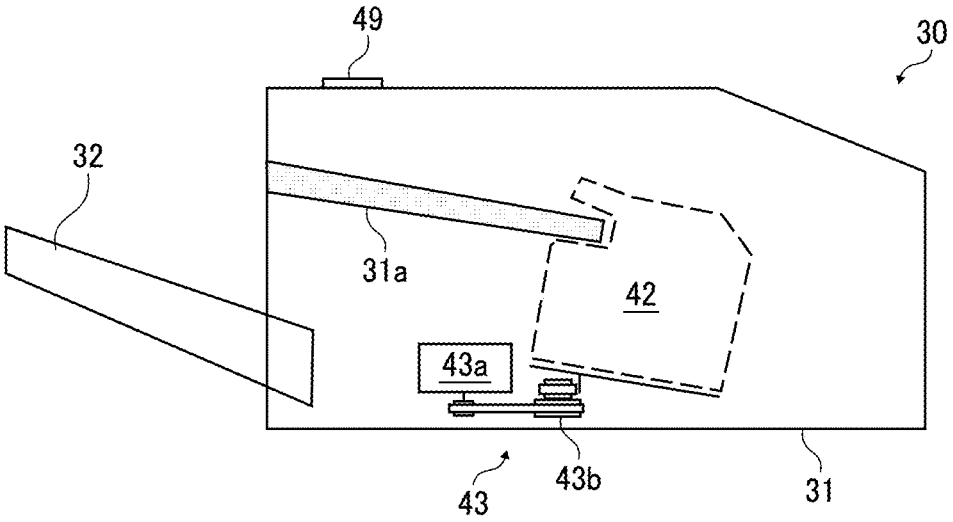
FIG. 6B illustrates the crimping unit viewed in the main scanning direction.

FIG. 6A illustrates the crimping unit 30 viewed in the thickness direction. FIG. 6B illustrates the crimping unit 30 viewed in the main scanning direction. The crimping unit 30 performs crimping processing (post-processing) such that a sheet bundle Sb on which an image is formed by the image former 12 is collectively bound. In the present embodiment, the crimping unit 30 will be described as an exemplary post-processing unit, but a specific exemplary post-processing unit (specific exemplary post-processing) is not limited to this. As illustrated in FIG. 2 and FIGS. 6A and 6B, the crimping unit 30 includes a binding case 31, an output tray 32, a plurality of conveying roller pairs 33, 34, 35, and 36 (conveyors), an inner tray 37, a tap roller 38, a return roller 39, end fences 40L and 40R, side fences 41L and 41R, a binder 42, a binder moving mechanism 43, and a manual binding button 49.

The binding case 31 is boxy in shape and has an inner space in which the constituent components of the crimping unit 30 are housed. The inner space of the binding case 31 is provided with a conveyance path Ph2 serving as a space through which a sheet S passes. The output tray 32 is supported by an outer side face of the binding case 31. The output tray 32 supports a sheet S or a sheet bundle Sb conveyed by the conveying roller pairs 33 to 36.

The conveying roller pairs 33 to 36 are disposed at predetermined intervals on the conveyance path Ph2. The conveying roller pairs 33 to 36 convey a sheet S along the conveyance path Ph2. The conveying roller pair 33 includes a drive roller 33*a* and a driven roller 33*b* that are disposed opposite across the conveyance path Ph2. The drive roller 33*a* and the driven roller 33*b* are supported rotatably by the binding case 31. In response to transmission of rotation drive force from a conveying motor, the drive roller 33*a* rotates forward in the direction of conveyance of the sheet S (clockwise in FIG. 2). The driven roller 33*b* is disposed opposite the drive roller 33*a* across the conveyance path Ph2 and is driven along with rotation of the drive roller 33*a*. Then, with the drive roller 33*a* and the driven roller 33*b* pinching the sheet S, in response to drive of the conveying motor, the sheet S is conveyed along the conveyance path Ph2.

The conveying roller pairs 34 to 36 each have a basic configuration in common with the conveying roller pair 33. Note that the conveying roller pair 36 includes a drive roller 36*a* and a driven roller 36*b* contactable with and separable from the drive roller 36*a*. For implementation of sorting processing in which a sheet S is shifted widthwise and is discharged to the output tray 32, the conveying roller pair 35 may be slidable widthwise.

The inner tray 37 temporarily supports (bears) a plurality of sheets S to be conveyed by the conveying roller pair 36. The tap roller 38 is supported by the leading end of a pivot arm above the inner tray 37. In response to pivoting of the pivot arm, the tap roller 38 supplies the sheet S pinched by the conveying roller pair 36 to the inner tray 37. The return roller 39 rotates in contact with the upper face of the sheet S supported by the inner tray 37 to guide the sheet S to the conveying roller pair 36. Hereinafter, the direction from the conveying roller pair 36 to the end fences 40L and 40R is referred to as a "second conveyance direction", and the direction orthogonal to the second conveyance direction and the thickness direction of the sheet S supported by the inner tray 37 is referred to as the "main scanning direction".

In contact with the end portion on the downstream side in the second conveyance direction of the sheet S supported by the inner tray 37, the end fences 40L and 40R align the position in the second conveyance direction of the sheet S. In contact with both end portions in the width direction of the sheet S supported by the inner tray 37, the side fences 41L and 41R align the position in the main scanning direction of the sheet S.

The binder 42 is disposed near the end portion on the downstream side in the second conveyance direction of the sheet bundle Sb supported by the inner tray 37. The binder 42 is movable, in the main scanning direction orthogonal to the second conveyance direction, along the sheet bundle Sb supported by the inner tray 37. The binder 42 performs crimping processing such that the sheet bundle Sb is bound due to deformation under pressure. The crimping processing is processing of pinching the sheet bundle Sb by a pair of binding teeth from both sides in the thickness direction of the sheet bundle Sb and tangling its sheet fiber to bind the sheet bundle Sb. The crimping unit 30 may further include a stapler that staples the sheet bundle Sb.

The binder moving mechanism 43 moves the binder 42 in the main scanning direction. The binder moving mechanism 43 includes a binder moving motor 43*a*, pulleys 43*b* and 43*c*, and timing belts 43*d* and 43*e*. The timing belt 43*d* is stretched around the output shaft of the binder moving motor 43*a* and the pulley 43*b*. The timing belt 43*e* is stretched around the pulleys 43*b* and 43*c*. Furthermore, the binder 42 is attached to the timing belt 43*e*. Thus, in response to transmission of rotation drive force from the binder moving motor 43*a*, the binder 42 moves to a third position (refer to FIG. 10) and a fourth position (refer to FIG. 6A) in the main scanning direction.

The third position is a position at which the binder 42 can face the sheet bundle Sb supported by the inner tray 37. In other words, the third position is a position at which the sheet bundle Sb supported by the inner tray 37 can be crimped (auto crimping). Note that the third position is not limited to the position in FIG. 10 and thus may be any position in the main scanning direction, provided that the binder 42 can face the sheet bundle Sb supported by the inner tray 37. The fourth position is the position of a side end portion in the main scanning direction of the crimping unit 30. In other words, the fourth position is a position at which the sheet bundle Sb inserted through a binding slit 31*a* described later of the binding case 31 can be crimped (manual crimping).

The binding case 31 is provided with the binding slit 31*a* for manual binding such that the binder 42 faces the binding slit 31*a*. A corner of the sheet bundle Sb inserted inside the binding case 31 through the binding slit 31*a* can be subjected to manual binding by the binder 42 at the fourth position. The binding case 31 further includes guide walls 31*b* and 31*c* surrounding the binding slit 31*a*. The guide wall 31*b* positions, in the second conveyance direction, the sheet bundle Sb to be subjected to manual binding (namely, the sheet bundle Sb of which a corner is inserted in the binding slit 31*a*). The guide wall 31*c* positions, in the main scanning direction, the sheet bundle Sb to be subjected to manual binding (namely, the sheet bundle Sb of which a corner is inserted in the binding slit 31*a*).

The manual binding button 49 gives an instruction for manual binding to the crimping unit 30. A user inserts a sheet bundle into the binder 42 through the binding slit 31*a* and then presses the manual binding button 49 to cause the binder 42 to perform manual binding.

FIG. 7 illustrates a hardware configuration of the image forming apparatus 10. As illustrated in FIG. 7, the image forming apparatus 10 includes a central processing unit (CPU) 101, a random-access memory (RAM) 102, a read-only memory (ROM) 103, a hard disk drive (HDD) 104, and an interface (I/F) 105 that are connected through a common bus 109.

The CPU 101 is an arithmetic unit and controls the entire operation of the image forming apparatus 10. The RAM 102 is a volatile storage medium that allows information to be read therefrom or written thereto at high speed. The CPU 101 uses the RAM 102 as a working area for information processing. The ROM 103 is a read-only non-volatile storage medium and stores a program, such as firmware. The HDD 104 is a non-volatile storage medium that is large in storage capacity and allows information to be read therefrom or written thereto. The HDD 104 stores, for example, an operating system (OS), various types of control programs, and an application program.

With the arithmetic function of the CPU 101, the image forming apparatus 10 processes, for example, a control program stored in the ROM 103 and an information processing program (application program) loaded into the RAM 102 from a storage medium such as the HDD 104. Due to such processing, provided is a software controller including various functional modules for the image forming apparatus 10. The software controller having such a configuration and the hardware resources with which the image forming apparatus 10 is equipped in combination provide functional blocks that implement functions of the image forming apparatus 10. That is, the CPU 101, the RAM 102, the ROM 103, and the HDD 104 serve as a controller 100 that controls the operation of the image forming apparatus 10.

The I/F 105 is an interface that connects, to the common bus 109, the image former 12, the contact-separation motor 24*a*, the liquid-applier moving motor 25*a*, the sheet sensor 28, the manual application button 29, the binder 42, the binder moving motor 43*a*, the manual binding button 49, and an operation panel 110. The controller 100 acquires, through the I/F 105, various types of information from the sheet sensor 28, the manual application button 29, the manual binding button 49, and the operation panel 110 to operate the image former 12, the liquid-applier moving motor 25*a*, the binder 42, and the binder moving motor 43*a*.

Note that the controller 100 illustrated in FIG. 7 collectively controls the image former 12, the liquid application unit 20, and the crimping unit 30. As another example, a controller that controls the operation of the image former 12, a controller that controls the operation of the liquid application unit 20, and a controller that controls the operation of the crimping unit 30 may operate, in mutual communication, the image former 12, the liquid application unit 20, and the crimping unit 30 together.

The operation panel 110 includes an operation unit that receives an operation from a user and a display (notifier) that notifies the user of information. The operation unit includes, for example, hardware keys and a touch panel overlaid on the display. Then, the operation panel 110 acquires information from an operator through the operation unit and provides the operator with information through the display. Note that a specific exemplary notifier is not limited to such a display and thus may be a light emitting diode (LED) lamp or a speaker.

Next, a procedure of manual application and manual binding will be described with reference to FIGS. 4A to 4C and FIGS. 6A and 6B. A user prepares a sheet bundle Sb that is a stack of sheets S. Next, the user inserts the sheet bundle Sb into the liquid application case 21 through the liquid application slit 21*a* and then presses the manual application button 29.

In response to the press on the manual application button 29, the controller 100 drives the liquid-applier moving motor 25*a* to move the liquid applier 24 to the second position indicated in FIG. 4C. Thus, a corner of the sheet bundle Sb enters the V-shaped groove 26*e* and then is supplied with liquid from the elastic member 26*b*. Then, the liquid applied to a side face of the sheet bundle Sb spreads over a predetermined area of the sheet bundle Sb illustrated in FIG. 5C through the fiber of the sheets S.

Next, the user removes, from the liquid application slit 21*a*, the sheet bundle Sb subjected to the liquid manual application. Next, the user inserts the sheet bundle Sb subjected to the liquid manual application into the binding case 31 through the binding slit 31*a* and then presses the manual binding button 49.

In response to the press on the manual binding button 49, the controller 100 drives the binder moving motor 43*a* to move the binder 42 to the fourth position indicated in FIG. 6A. Next, the controller 100 drives the binder 42 to crimp the corner (part subjected to the liquid manual application) of the sheet bundle Sb inserted in the binding case 31 through the binding slit 31*a*.

Figure 8A:
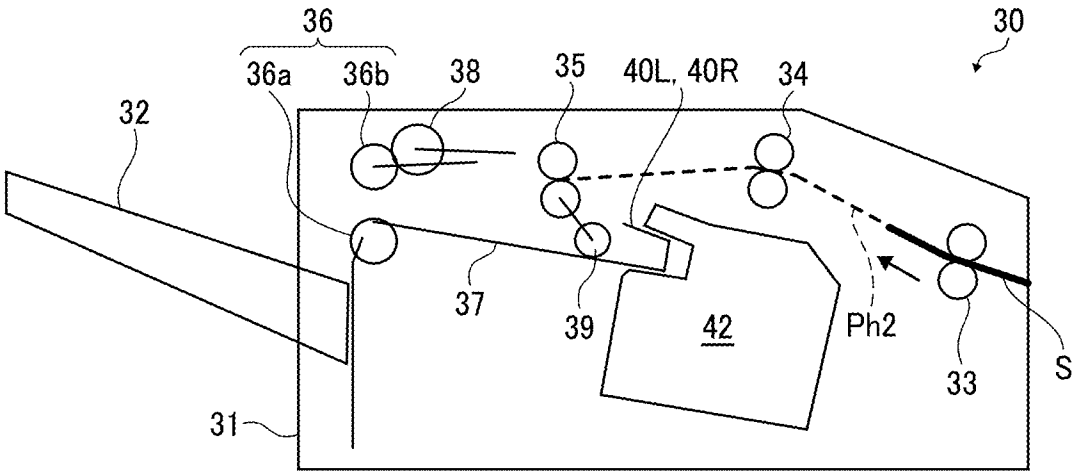
FIGS. 8A and 8B illustrate states of the crimping unit until a sheet reaches a conveying roller pair.
Figure 8B:
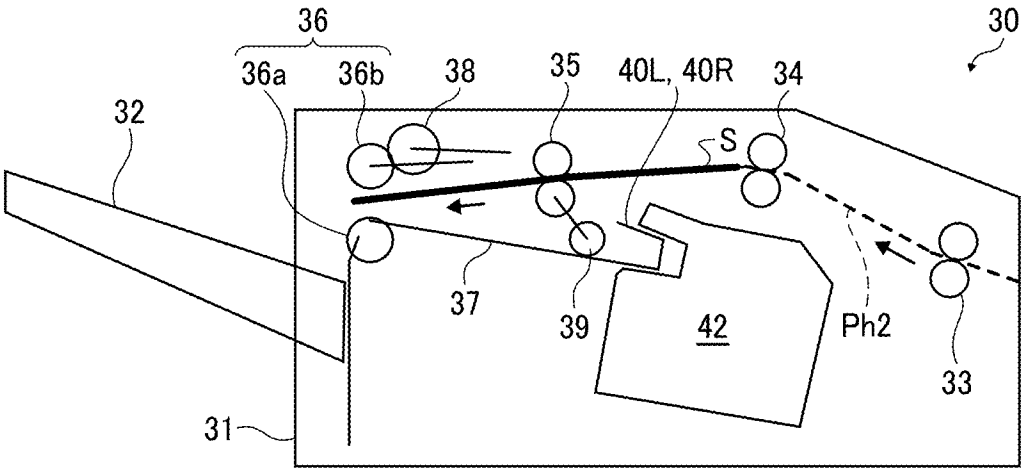
Figure 9A:
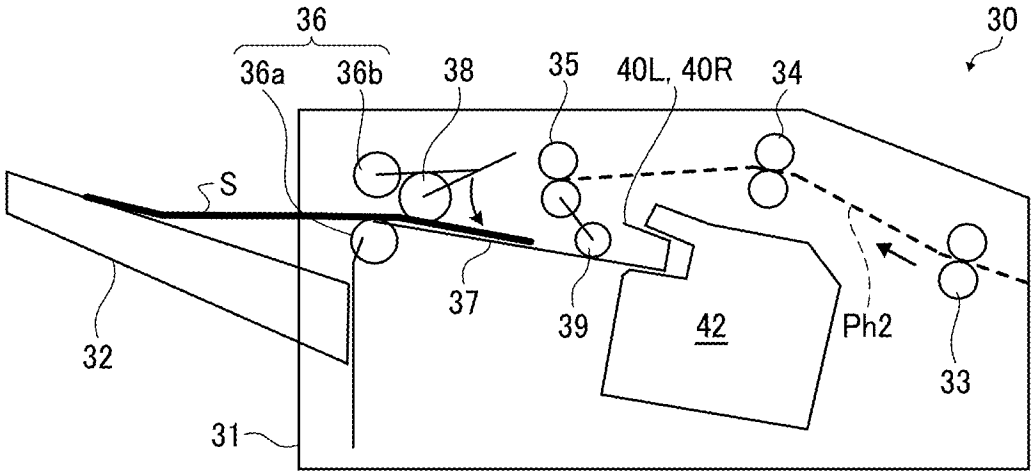
FIGS. 9A and 9B illustrate states of the crimping unit that performs auto binding.
Figure 9B:
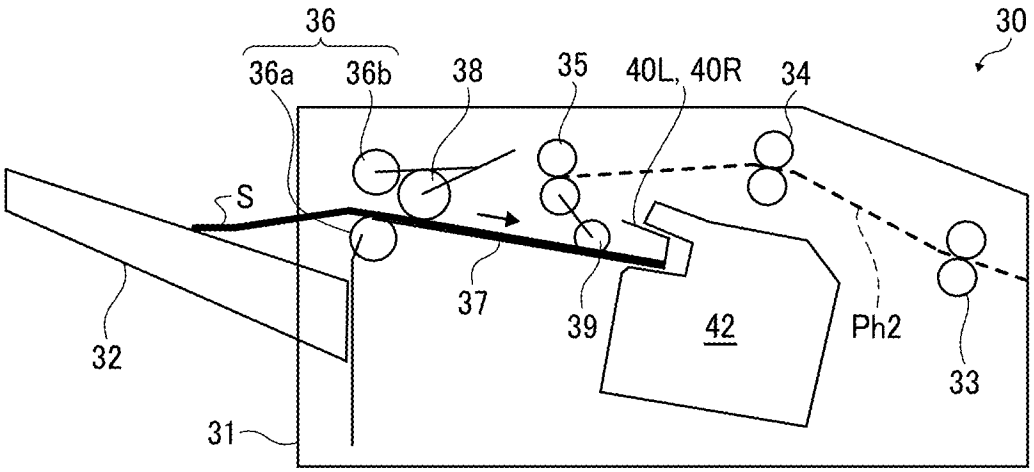
Figure 10:
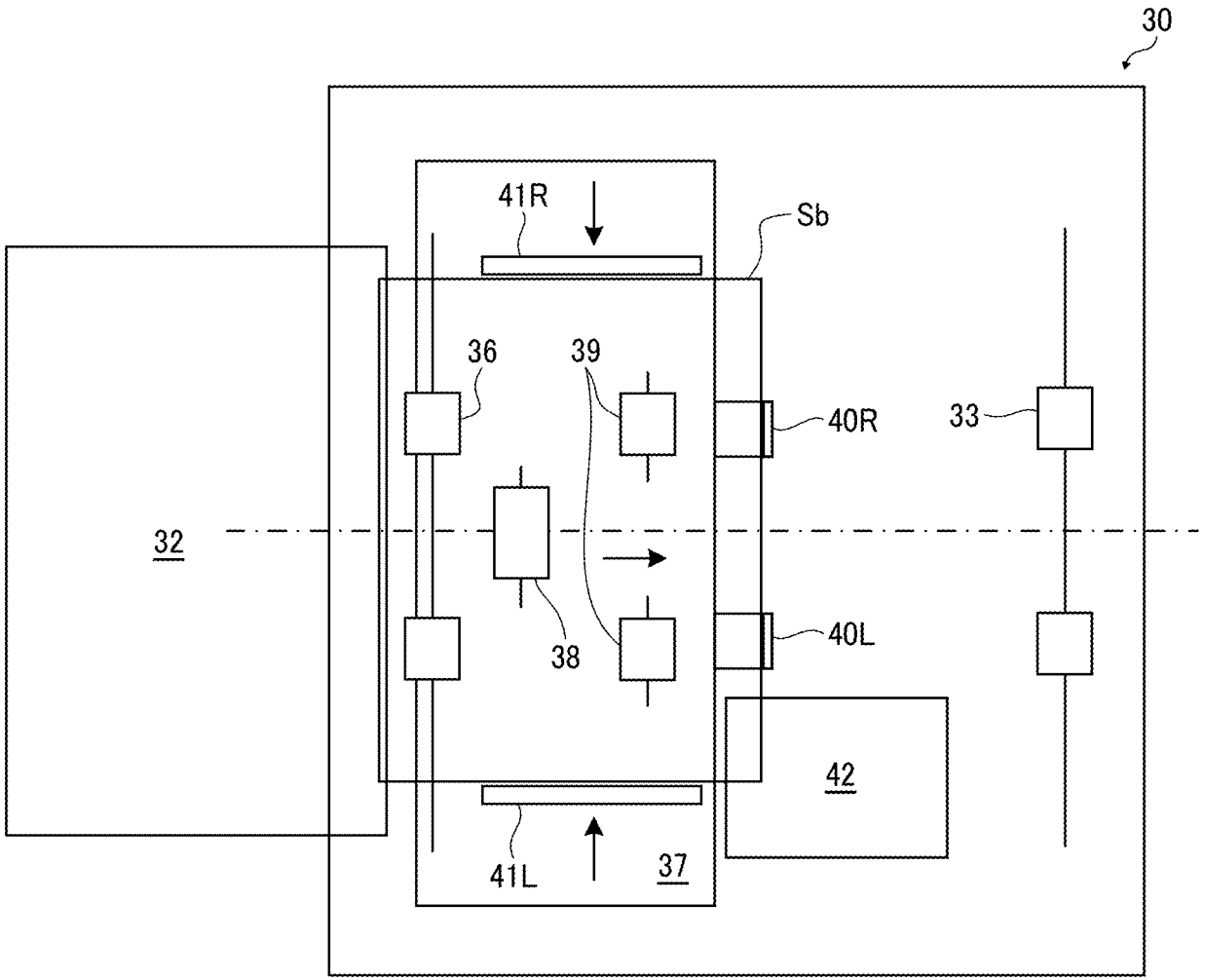
FIG. 10 illustrates the crimping unit in FIG. 9B viewed in the thickness direction of a sheet.
Figure 11A:
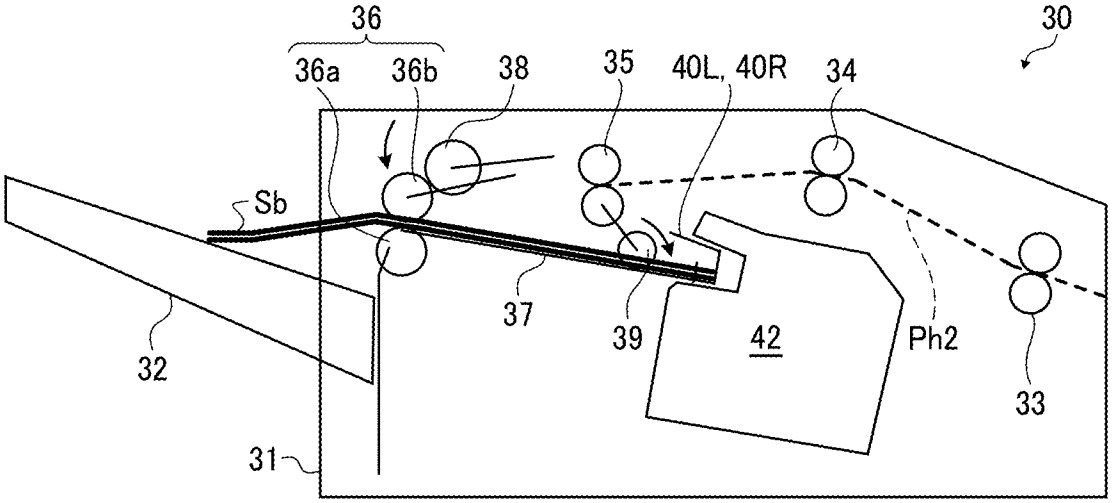
FIGS. 11A and 11B illustrate states of the crimping unit that discharges, to an output tray, a sheet bundle subjected to auto binding.
Figure 11B:
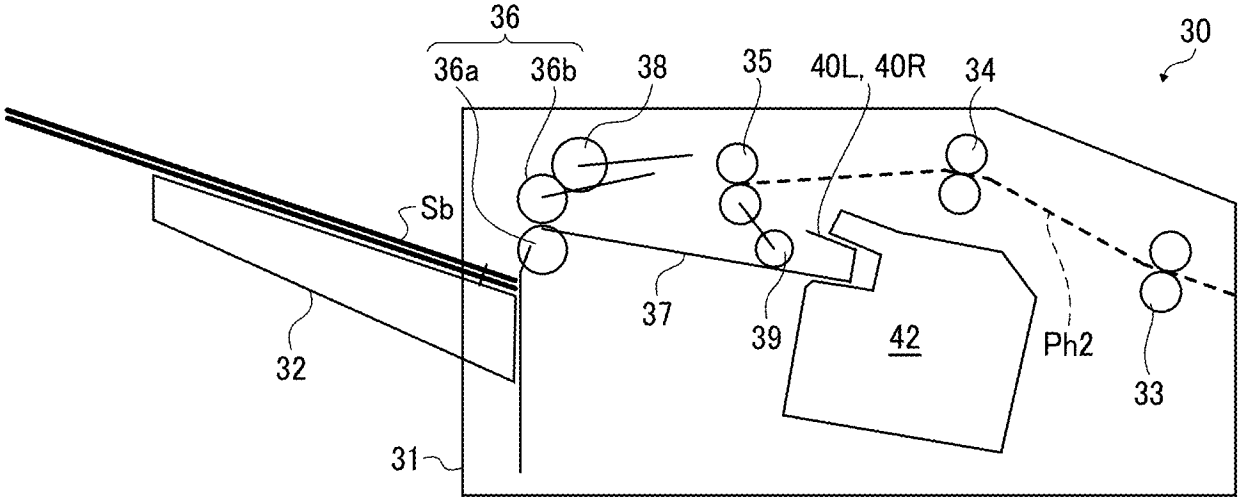

Next, processing of auto application and auto binding will be described with reference to FIG. 4B and FIGS. 8A to 11B. FIGS. 8A and 8B illustrate states of the crimping unit 30 until a sheet S reaches the conveying roller pair 36. FIGS. 9A and 9B illustrate states of the crimping unit 30 that performs auto binding. FIG. 10 illustrates the crimping unit 30 in FIG. 9B viewed in the thickness direction of a sheet S. FIGS. 11A and 11B illustrate states of the crimping unit 30 in a case where a sheet bundle Sb subjected to auto binding is discharged to the output tray 32.

In response to input of an instruction for image forming through the operation panel 110, the controller 100 causes the image former 12 to form an image onto a sheet S and output the sheet S on which the image is formed to the crimping unit 30 through the liquid application unit 20. More particularly, the controller 100 discharges the sheet S to the conveying roller pair 33 of the crimping unit 30 through the liquid application unit 20. The instruction for image forming includes the number of sheets S for image forming. Thus, the controller 100 causes the image former 12 to form an image onto sheets S, of which the number is indicated by the instruction for image forming, in order.

Next, as illustrated in FIG. 4B, when the sheet sensor 28 detects that the binding position of the sheet S output from the image former 12 faces the liquid applier 24, the controller 100 drives the contact-separation motor 24*a* to cause the first face 26*c* of the contact member 26 to contact the binding position of the sheet S. Thus, the liquid contained in the elastic member 26*b* is applied to the binding position of the sheet S.

Next, as illustrated in FIGS. 8A and 8B, the controller 100 rotates the conveying roller pairs 33 to 35 forward to convey the sheet S supplied from the liquid application unit 20 in the second conveyance direction along the conveyance path Ph2. In this case, the conveying roller pair 36 has the drive roller 36*a* and the driven roller 36*b* separated from each other.

Next, as illustrated in FIGS. 9A and 9B, the controller 100 rotates the tap roller 38 in contact with the sheet S having passed through the conveying roller pair 35, so that the sheet S is housed in the inner tray 37. As illustrated in FIG. 10, the crimping unit 30 moves the side fences 41L and 41R widthwise to align the position in the width direction of the sheet S housed in the inner tray 37.

Then, the controller 100 repeats the processing illustrated in FIGS. 4B, 8A, 8B, 9A, 9B, and 10 to provide a sheet bundle Sb on the inner tray 37. Next, when sheets S, of which the number is indicated by the instruction for image forming, are stacked on the inner tray 37, the controller 100 drives the binder moving motor 43*a* to cause the binder 42 to face the binding position of the sheet bundle Sb. Next, the controller 100 drives the binder 42 to bind the sheet bundle Sb supported by the inner tray 37.

Next, as illustrated in FIG. 11A, the controller 100 rotates the return roller 39 in contact with the crimped sheet bundle Sb, so that the sheet bundle Sb is pinched by the drive roller 36*a* and the driven roller 36*b*. Then, as illustrated in FIG. 11B, the controller 100 rotates the conveying roller pair 36 forward to discharge the sheet bundle Sb to the output tray 32.

According to the embodiment described above, for example, the following functional effects can be obtained.

According to the embodiment described above, not only liquid can be applied to a sheet S to be subjected to auto binding (auto application) but also liquid can be applied to a sheet bundle Sb to be subjected to manual binding (manual application). Thus, improvements can be made both in the strength of binding in auto binding and in the strength of binding in manual binding.

According to the embodiment described above, the contact member 26 (elastic member 26*b*) contacts the sheet S or the sheet bundle Sb, so that liquid can be reliably applied to any position of the sheet S or the sheet bundle Sb. On the other hand, as in FIG. 5B, in a case where the sprayer 27 is adopted, a small amount of liquid can be applied to a wide range of the sheet S or the sheet bundle Sb.

According to the embodiment described above, even in a case where the sheet bundle Sb is inserted at a slight angle through the liquid application slit 21*a*, since the elastic member 26*b* contacts the sheet bundle Sb, liquid can be properly applied to the sheet bundle Sb having its side face in contact with the elastic member 26*b*.

According to the embodiment described above, the elastic member 26*b* contacts a side face of the sheet bundle Sb inserted through the liquid application slit 21*a*, so that liquid can permeate not only the face of the sheet bundle Sb (upper face and lower face) but also the inside of the sheet bundle Sb. Furthermore, since the elastic member 26*b* is provided with the V-shaped groove 26*e*, liquid can be applied to two side faces across a corner of the sheet bundle Sb. Thus, a further improvement can be made in the strength of binding in manual binding.

Furthermore, the liquid application unit 20 according to the embodiment described above is attached to the internal space 13 of the image forming apparatus 10 limited in space, leading to a particularly advantageous effect. Note that a constituent component to be attached to the internal space 13 is not limited to the liquid application unit 20. The position of attachment of the liquid application unit 20 is not limited to the internal space 13.

Modification 1

Figure 12A:
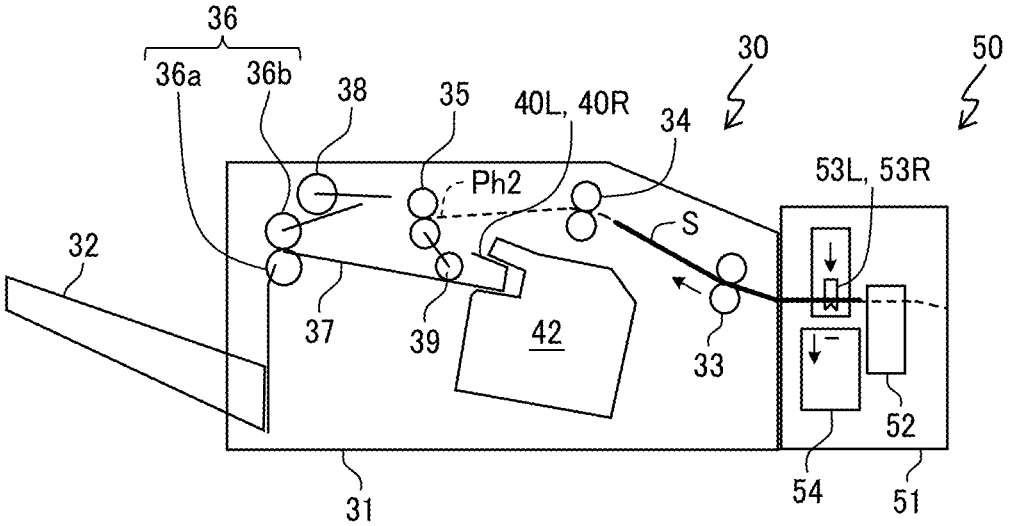
FIGS. 12A and 12B each illustrate an inner configuration of a hole punch unit.
Figure 12B:
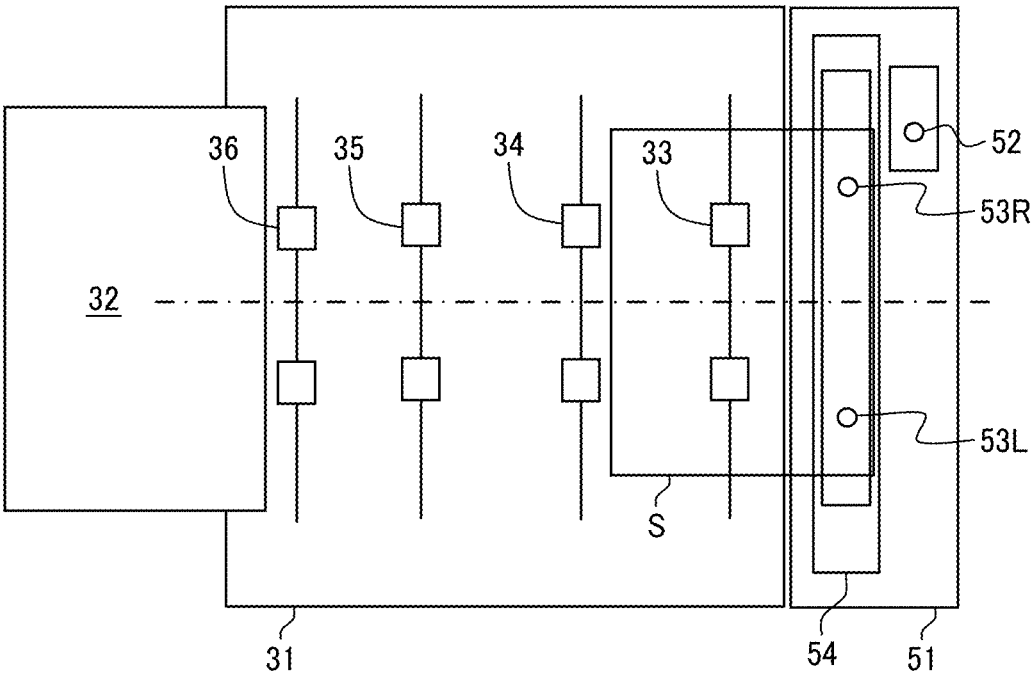

FIGS. 12A and 12B each illustrate an inner configuration of the hole punch unit 50 (hole puncher). The hole punch unit 50 illustrated in FIGS. 12A and 12B is detachably attachable to the position from which the liquid application unit 20 is detached in the internal space 13. That is, the image forming apparatus 10 enables attachment of either the liquid application unit 20 or the hole punch unit 50 depending on the use. Note that the hole punch unit 50 has a publicly known configuration and thus detailed description thereof will be omitted. For example, the hole punch unit 50 may have the following configuration.

As illustrated in FIGS. 12A and 12B, the hole punch unit 50 includes a housing 51, a sheet sensor 52, hole pins 53L and 53R, and a punched-out waste hopper 54. The housing 51 has an inner space in which the constituent components of the hole punch unit 50 are housed. The inner space of the housing 51 is provided with a conveyance path through which a sheet on which an image is formed by the image former 12 passes. The sheet sensor 52 detects that the sheet S supplied from the image former 12 has reached a predetermined position. The hole pins 53L and 53R punch holes in the sheet S detected by the sheet sensor 52. The punched-out waste from the sheet S falls in the punched-out waste hopper 54. Thus, implemented is punching processing in which holes are punched in the sheet S.

Modification 2

Figure 13:
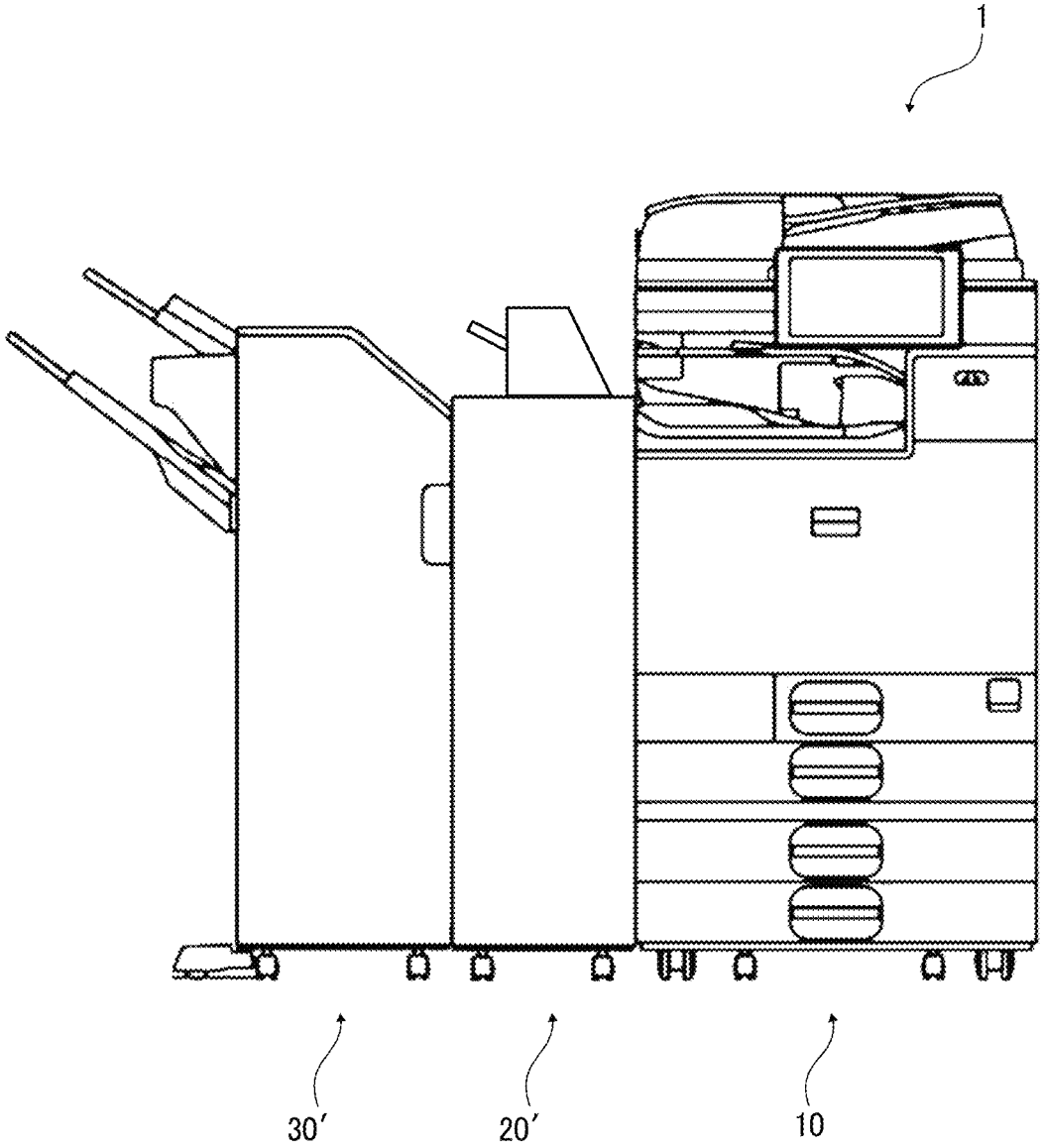
FIG. 13 is an external view of an image forming system.

FIG. 13 is an external view of an image forming system 1. As illustrated in FIG. 13, the image forming system 1 includes an image forming apparatus 10, a liquid application device 20', and a crimping device 30'. The image forming apparatus 10, the liquid application device 20', and the crimping device 30' can operate independently of each other and additionally are mutually connectable. The liquid application device 20' has a configuration in common with the liquid application unit 20 described above, and the crimping device 30' has a configuration in common with the crimping unit 30 described above.

Note that embodiments of the present disclosure are not limited to the embodiments described above, and thus various modifications can be made without departing from the technical gist thereof. The present disclosure corresponds to every technical matter in the technical idea of the claims. The embodiments described above are preferred exemplifications. Various modifications can be conceived by those skilled in the art from such disclosed embodiments. Such modifications are to be included in the technical scope of the claims.

Any one of the above-described operations may be performed in various other ways, for example, in an order different from the one described above.

Aspects of the present disclosure are, for example, as follows:

First Aspect

A liquid application device for applying liquid to a plurality of media to be crimped by a crimping device includes: a liquid applier to apply liquid to the plurality of media; a liquid application case having a conveyance path that allows a medium of the plurality of media to pass in a conveyance direction inside the liquid application case; and a liquid-applier moving to move the liquid applier to a first position at which the liquid applier applies liquid to the medium on the conveyance path and a second position at which the liquid applier applies liquid to the plurality of media inserted through a liquid application slit in a side face of the liquid application case.

Second Aspect

In the liquid application device according to the first aspect, the liquid applier includes a sprayer to spray liquid to the plurality of media.

Third Aspect

In the liquid application device according to the first aspect, the liquid applier includes a contact member to contact the plurality of media with liquid contained in the contact member.

Fourth Aspect

In the liquid application device according to the third aspect, the contact member includes an elastic member.

Fifth Aspect

In the liquid application device according to the fourth aspect, the contact member has a first face to contact the medium on the conveyance path and a second face intersecting the first face to contact the plurality of media inserted through the liquid application slit.

Sixth Aspect

In the liquid application device according to the fifth aspect, the second face contacts a side face of the plurality of media inserted through the liquid application slit.

Seventh Aspect

In the liquid application device according to the fifth aspect, the second face contacts two side faces of the plurality of media inserted through the liquid application slit, the two side faces intersecting at a corner of the plurality of media.

Eighth Aspect

In the liquid application device according to any one of the fifth to seventh aspects, the first face contacts an upper face of the medium on the conveyance path.

Ninth Aspect

An image forming apparatus includes: a housing; an image former housed in the housing to form an image on a medium; and the liquid application device according to any one of the first to eighth aspects. The liquid application device is detachably supported by the housing to apply liquid to the medium on which the image is formed by the image former.

Tenth Aspect

The image forming apparatus according to the ninth aspect further includes a crimping device supported by the housing. The crimping device includes: a conveyor to convey the medium having passed through the conveyance path of the liquid application device; a tray to support the plurality of media conveyed by the conveyor; a binder to deform the plurality of media under pressure to crimp the plurality of media; a binding case housing the conveyor, the tray, and the binder, the binding case being supported by the housing and having a binding slit in a side face of the binding case; and a binder moving mechanism to move the binder to a third position at which the binder crimps the plurality of media supported by the tray and a fourth position at which the binder crimps a plurality of media inserted through the binding slit.

Eleventh Aspect

An image forming system includes: an image forming apparatus to form an image on a medium; and the liquid application device according to any one of the first to eighth aspects. The liquid application device is connected to the image forming apparatus.

The invention claimed is:

1. A liquid application device for applying liquid to a plurality of media to be crimped by a crimping device, the liquid application device comprising:

a liquid applier to apply liquid to the plurality of media; and a liquid-applier moving mechanism to move the liquid applier to a first position at which the liquid applier applies liquid to a medium on a conveyance path in the liquid application device and a second position at which the liquid applier applies liquid to the plurality of media inserted through a liquid application slit of the liquid application device, wherein the liquid applier is configured to apply liquid to an upper face of the medium at the first position and a side face of the plurality of media at the second position.

2. The liquid application device according to claim 1, wherein the liquid applier includes a sprayer to spray liquid to the plurality of media.

3. The liquid application device according to claim 1, wherein the liquid applier includes a contact member to contact the plurality of media with liquid contained in the contact member.

4. The liquid application device according to claim 3, wherein the contact member includes an elastic member.

5. The liquid application device according to claim 4, wherein the contact member has:

a first face to contact the medium on the conveyance path; and a second face intersecting the first face to contact the plurality of media inserted through the liquid application slit.

6. The liquid application device according to claim 5, wherein the second face contacts the side face of the plurality of media inserted through the liquid application slit.

7. The liquid application device according to claim 5, wherein the second face contacts two side faces of the plurality of media inserted through the liquid application slit, the two side faces intersecting at a corner of the plurality of media.

8. The liquid application device according to claim 5, wherein the first face contacts the upper face of the medium on the conveyance path.

9. An image forming apparatus comprising:

a housing;

an image former housed in the housing to form an image on a medium; and the liquid application device according to claim 1, wherein the liquid application device is detachably supported by the housing to apply liquid to the medium on which the image is formed by the image former.

10. The image forming apparatus according to claim 9, further comprising a crimping device supported by the housing, the crimping device including:

a conveyor to convey the medium having passed through the conveyance path of the liquid application device;

a tray to support the plurality of media conveyed by the conveyor;

a binder to deform the plurality of media under pressure to crimp the plurality of media;

a binding case housing the conveyor, the tray, and the binder, the binding case being supported by the housing and having a binding slit in a side face of the binding case; and a binder moving mechanism to move the binder to a third position at which the binder crimps the plurality of media supported by the tray and a fourth position at which the binder crimps a plurality of media inserted through the binding slit.

11. An image forming system comprising:

an image forming apparatus to form an image on a medium; and the liquid application device according to claim 1, the liquid application device being connected to the image forming apparatus.

12. A liquid application device for applying liquid to a plurality of media to be crimped by a crimping device, the liquid application device comprising:

a liquid applier to apply liquid to the plurality of media; and a liquid-applier moving mechanism to move the liquid applier to a first position at which the liquid applier applies liquid to a medium on a conveyance path in the liquid application device and a second position at which the liquid applier applies liquid to the plurality of media inserted through a liquid application slit of the liquid application device, wherein the liquid applier includes a contact member to contact the plurality of media with liquid contained in the contact member, wherein the contact member includes an elastic member, and wherein the contact member has a first face to contact the medium on the conveyance path; and a second face intersecting the first face to contact the plurality of media inserted through the liquid application slit.

13. The liquid application device according to claim 12, wherein the second face contacts a side face of the plurality of media inserted through the liquid application slit.

14. The liquid application device according to claim 12, wherein the second face contacts two side faces of the plurality of media inserted through the liquid application slit, the two side faces intersecting at a corner of the plurality of media.

15. The liquid application device according to claim 12, wherein the first face contacts an upper face of the medium on the conveyance path.

16. An image forming apparatus comprising:

a housing;

an image former housed in the housing to form an image on a medium; and a liquid application device for applying liquid to a plurality of media, wherein the liquid application device includes a liquid applier to apply liquid to the plurality of media; and a liquid-applier moving mechanism to move the liquid applier to a first position at which the liquid applier applies liquid to a medium on a conveyance path in the liquid application device and a second position at which the liquid applier applies liquid to the plurality of media inserted through a liquid application slit of the liquid application device, and wherein the liquid application device is detachably supported by the housing to apply liquid to the medium on which the image is formed by the image former.

17. The image forming apparatus according to claim 16, further comprising a crimping device supported by the housing, the crimping device including:

a conveyor to convey the medium having passed through the conveyance path of the liquid application device;

a tray to support the plurality of media conveyed by the conveyor;

a binder to deform the plurality of media under pressure to crimp the plurality of media;

a binding case housing the conveyor, the tray, and the binder, the binding case being supported by the housing and having a binding slit in a side face of the binding case; and a binder moving mechanism to move the binder to a third position at which the binder crimps the plurality of media supported by the tray and a fourth position at which the binder crimps a plurality of media inserted through the binding slit.

* * * * *